US005463887A

United States Patent [19]

Vasseur

[11] Patent Number: 5,463,887

[45] Date of Patent: Nov. 7, 1995

[54] DEVICE FOR THE PREPARATION OF USED METAL BARRELS WITH A VIEW TO FACILITATING HANDLING AND RECYCLING THEREOF

[75] Inventor: Jean-Claude Vasseur, Saint Witz, France

[73] Assignee: Sfanid Renov'cuves, Goussainville, France

[21] Appl. No.: 182,396

[22] Filed: Jan. 18, 1994

[30] Foreign Application Priority Data

Jan. 20, 1993 [FR] France ..... 93 00753

[51] Int. Cl.[6] ..... B21D 28/00; B30B 9/32

[52] U.S. Cl. ..... 72/39; 72/325; 72/453.01; 100/98 R; 100/902; 134/167 R

[58] Field of Search ..... 72/325, 39, 453.01; 100/902, 98 R, 70 R; 134/167 R, 172, 166 R

[56] References Cited

U.S. PATENT DOCUMENTS

| | | | |
|---|---|---|---|
| 3,142,306 | 7/1964 | Boka | 134/166 R |
| 3,993,221 | 11/1976 | Boynton et al. | 100/98 R |
| 4,126,160 | 11/1978 | Gurtler | 100/DIG. 2 |
| 4,719,780 | 1/1988 | Ristimaki | 72/325 |
| 4,961,440 | 10/1990 | Wright | 134/167 R |

FOREIGN PATENT DOCUMENTS

| | | |
|---|---|---|
| 0353855 | 2/1990 | European Pat. Off. . |
| 0410835 | 1/1991 | European Pat. Off. . |
| 2082540 | 3/1982 | United Kingdom . |

*Primary Examiner*—Daniel C. Crane
*Attorney, Agent, or Firm*—Browdy and Neimark

[57] ABSTRACT

The device embodying the invention uses a hydraulic press activating a mobile plate in a chamber opposite a base on which a metal barrel can be disposed, and successively comprises: the placing and maintaining of the barrel on the base; the perforating of two opposite sides of the barrel by means of an elongated perforating mechanism running through the barrel from side to side and from top to bottom; the cleaning of the interior of the barrel by projection of a cleansing fluid under pressure by means of a rotary injection head integral with the perforating mechanism; and the crushing of the barrel by displacement of the plate towards the base. The invention notably concerns the processing of polluted metal barrels with a view to facilitating handling, storage and recycling thereof.

11 Claims, 2 Drawing Sheets

DEVICE FOR THE PREPARATION OF USED METAL BARRELS WITH A VIEW TO FACILITATING HANDLING AND RECYCLING THEREOF

BACKGROUND OF THE INVENTION

1. Field of the Invention

The object of this invention is to provide a device for the cleaning and crushing of metal barrels.

It relates notably, though not exclusively, to the processing of used metal barrels with a view to facilitating handling and storage thereof before possible recycling.

2. Description of the Prior Art

A large number of used metal barrels are currently stored in dumps for various reasons.

Firstly, they are cumbersome to transport and there are few recycling units in operation.

In endeavouring to obviate this problem, the idea was put forward that a press be used to reduce them to the shape of a thin cake which is therefore much less cumbersome and much easier to handle. In this shape, they can be easily transported in order to recycle the metal constituting these barrels.

This solution, which is satisfactory for the processing of "clean" barrels, does not enable efficient processing of barrels having contained dangerous products. In fact, even when empty, they contain residues of these products in sufficient quantity to constitute risks of pollution and explosion.

For these reasons, they cannot really be processed by crushing or be recycled.

Moreover, transportation and storage thereof in dumps is subject to the very strict and highly restricting regulations applying to dangerous products.

Now, however, in an endeavour to protect the environment, such dumps are no longer authorized to increase their storage area and are destined to disappear in the more or less short term.

At the present moment, there is therefore no satisfactory solution for disposing of such barrels.

OBJECT OF THE INVENTION

The main object of this invention is to obviate this problem by means of a method combining the cleaning and reduction of the volume of these metal barrels by means of the utilization of a press activating a mobile crushing plate in a chamber opposite a base on which the barrels can be disposed.

SUMMARY OF THE INVENTION

The invention proposes to achieve this result by means of a device that can be retracted so that it can be displaced in a retracted position on a vehicle, such as e.g. a trailer or a truck.

According to the invention, this device uses a hydraulic press comprising:

- an enclosure forming the supporting structure of the press and intended to receive the barrel to be processed,
- a dual-action hydraulic jack of which the body is mounted on the upper side of the enclosure and whose rod, which passes through said side, bears at its lower end a crushing plate that is vertically mobile inside the enclosure,
- a base situated opposite the plate and on which the barrel is positioned,
- a perforating and cleaning mechanism comprised of a cylindrical tube mounted vertically slidable through an opening in the plate and ended, at its lower part, by a perforating head,
- a vertical gantry mounted fixedly on the plate, supporting the perforating and cleaning mechanism by means of a jack.

According to the invention, this device is more particularly characterized in that the assembly comprising the body of the jack, the gantry and the perforating and cleaning mechanism are mounted vertically slidable through the upper side of the enclosure, and in that a means is provided to perform a locking that can be disconnected from the jack body on said side, in order to obtain at least two positions, i.e.

- a retracted position in which the above-mentioned assembly is at least largely contained inside the enclosure, and
- an extended position in which the above-mentioned jack body is at least largely outside the enclosure, and in which the device can be operated.

According to an important feature of the invention, the perforating mechanism comprises the cleansing fluid injection head.

By way of this arrangement, the perforating phase is performed by a downward displacement of the perforating mechanism, while the cleaning phase is performed during the raising thereof to the initial position.

Advantageously, the injection head is rotatably driven about itself during the cleaning phase and projects the cleansing fluid under high pressure over the entire inner area of the barrel, the residual fluid being evacuated by simple gravity through the other perforation situated in the lower side of the barrel.

Furthermore, at the end of the crushing phase, the crushing plate returns to its initial position to enable removal of the crushed barrel and insertion of another barrel.

All these arrangements enable the processing, at a relatively high rate, of barrels contaminated by dangerous substances, with a view to recycling thereof.

In order to facilitate the perforation from one side of the barrel to the other, the conical head is fitted with radially protruding ribs extending along the cone generators.

By means of this arrangement, the perforations in the barrel are firstly obtained by the piercing of a hole of small diameter by means of the tip of the conical shape, then by tearing of the metal by means of the ribs.

In addition, the projection means is oriented according to three separate axes in order to ensure uniform projection of the cleansing fluid on the cylindrical side and on the upper and lower sides of the barrel.

Advantageously, the conical head and ribs are made from or coated with an explosion-proof material so as to avoid all risks of explosion during said perforation if the barrels to be processed have contained an explosive product.

In view of the fact that the lower side of the barrels usually has vertical rims, the perforating operations, which are performed from top to bottom, inevitably cause funnel-shaped deformations in the perforated surfaces. Likewise, the lips made by the tearing of the metal protrude downwards, thereby facilitating the evacuation flow of the residual cleansing fluid out of the barrel towards the retention vat.

Advantageously, the head raising speed and the pressure of projection of the cleansing fluid can be modulated as a function of the degree of contamination of the barrel.

Moreover, in order to facilitate removal of the crushed barrel and to avoid any accident that might be caused by the lips protruding from the lower drilling which can have sharp edges, the device also comprises a means for turning these lips back towards the inside of the barrel, which is activated during the crushing phase.

BRIEF DESCRIPTION OF THE DRAWINGS

An embodiment of the device according to the invention will be described hereinafter, by way of a non-limiting example, in reference to the corresponding accompanying drawings in which.

DESCRIPTION OF THE PREFERRED EMBODIMENTS

Figure 1:
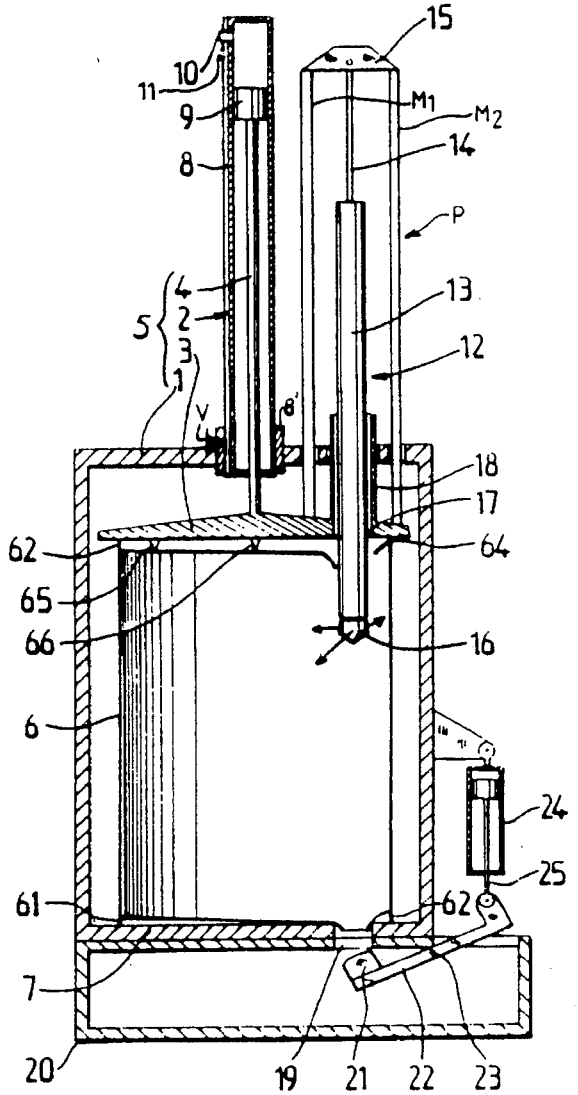
FIG. 1 schematically represents, in a partial axial sectional drawing, the device embodying the invention in the extended position (working position)

In FIG. 1, the device for cleaning and crushing metal barrels firstly uses a hydraulic press 5 comprising:

- an enclosure 1 forming the supporting structure of the press and destined to receive the barrel 6 to be processed,
- a dual-action hydraulic jack 2 comprising a cylinder body 8 inside which slides a piston 9 integral with a rod 4 and which delimits two work chambers in which a pressurized hydraulic fluid can be injected by means of openings 10, 11 (opening 11 communicating with the lower chamber by means of an axial channel extending substantially over the entire length of the cylinder body 8),
- a crushing plate 3 which is vertically mobile and activated by the rod 4 of the jack 2, and
- a base 7 situated opposite the plate 3 and on which the barrel 6 is placed.

This device also comprises a perforating and cleaning mechanism 12 comprised of a cylindrical tube 13 mounted vertically slidable through an opening 17 in the plate 3, by means of a cylindrical guide sleeve 18 integral with said plate 3.

The tube 13 is extended at its lower part by a cylindro-conical perforating head 16 of which the cylindrical part, substantially of the same diameter as the tube 13, bears a coaxial shaft 41 mounted rotational inside the tube 13 and whose conical part 43, oriented downwards, is fitted with radially protruding ribs extending along the generators of the cone.

Figure 3:
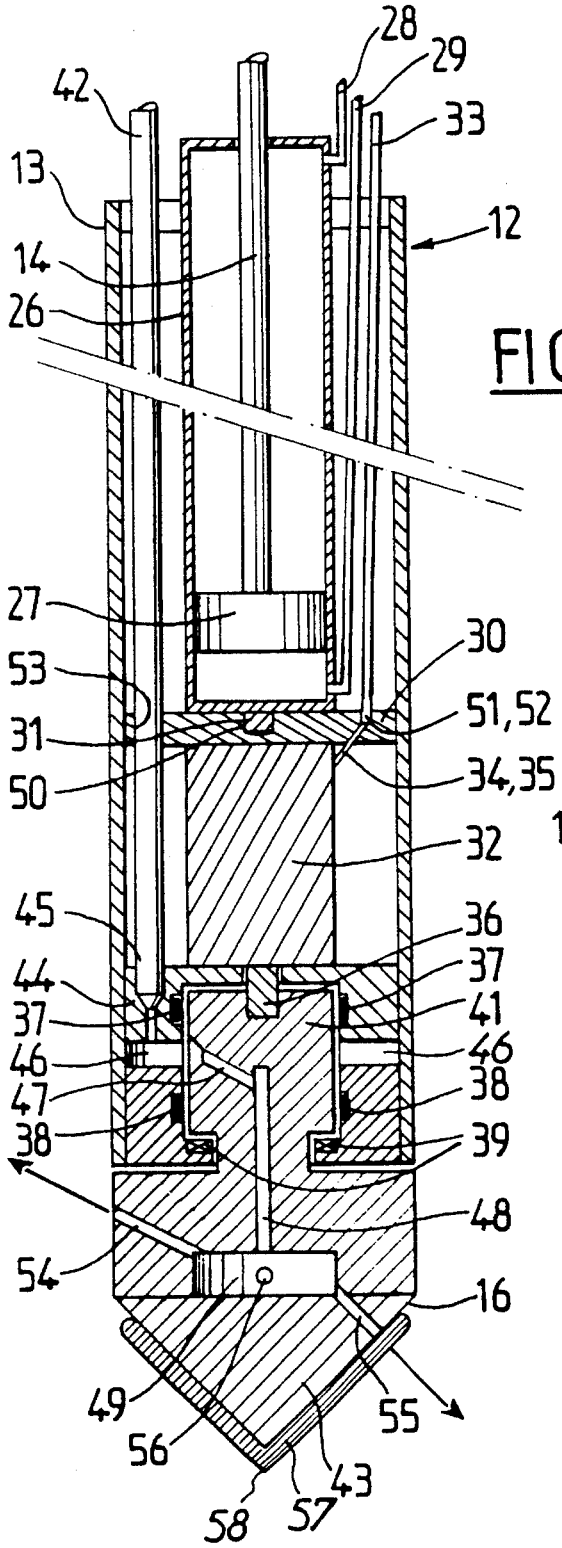
FIG. 3 shows an axial section of the drilling and cleaning head and its drive means.

It further encloses coaxially a dual-action hydraulic jack 26, represented in detail in FIG. 3, of which the rod 14 which exits via the upper opening in the tube 13, is attached to the cross-piece 15 of an inverted U-shaped gantry whose legs are attached to the plate 3.

In this example, the cylinder body 8, like the cylindrical tube 13 and the two vertical posts M1, M2 of the gantry P, are mounted slidable through the upper side of the enclosure 1 by means of appropriate openings. In this example, the opening through which slides the cylinder body 8 is extended by a tubular sleeve 8' fitted with a means V enabling axial locking of the jack, at least in the upper position represented in FIG. 1. This locking means V consists in this instance in binding screws screwing into tapped radial bores provided in the sleeve 8'.

The base 7 of the press 5 comprises a circular opening 19 situated coaxially with the tube 13 opening out into a retention vat 20 for the residual cleansing fluids.

This opening 19 also serves for the passage of a burring element 21 attached to an end of a lever 22 mounted tilting about a horizontal axis 23 and which is activated by a hydraulic jack 24 of which the rod 25 is integral with the other end of the lever 22.

As represented in FIG. 3, this jack 26 is of smaller diameter than the tube 13 in order to delimit with the latter an interposed volume for the passage of flexible pipes 28 and 29 feeding pressurized hydraulic fluid to the upper and lower chambers of the jack 26 delimited by the piston 27.

At its lower part, it is attached to the upper side of a disk 30 occupying substantially the entire right section of the tube 13 with which it is integral. In this example, this attachment is ensured by means of a screw 31 engaging coaxially in a tapped bore 50 of the disk 30.

The lower side of the disk 30 is attached to a hydraulic motor 32 intended to coaxially rotate the perforating head 16 during the cleaning phase.

Two flexible pipes 33 are inserted via the upper opening in the tube 13 to ensure the feeding of pressurized fluid and the return to the tank of the motor 32. These pipes are connected to through bores 51, 52 arranged in the disk 30 which are connected to the admission and exhaust openings of the motor 32 via two rigid pipes 34, 35.

The motor 32 comprises an output shaft 36 which is coupled to the perforating head 16 by the shaft 41 maintained coaxially and longitudinally by ring bearings 39.

Furthermore, the head 16 is fitted with three cleansing fluid injection channels 54, 55, 56 respectively oriented horizontally, and substantially at angles of 30° above and 45° below the horizontal axis. These three channels are used to project the cleansing fluid over the entire inner surface of the barrel 6.

The head is fed with cleansing fluid by a flexible channel 42 running through the tube 13 from top to bottom via a bore 53 provided in the disk 30 and an interposed volume situated between the motor 32 and the tube 13, before connecting up to an opening 45 in a collar 44 in which the shaft 36 is engaged. This opening 45 leads to a coaxial vortex distribution chamber 46 from which the head 16 is fed during its rotation about itself.

To this end, the cylindrical side of the shaft 41 comprises a channel 47 flared on one side, forming with the vortex chamber 46 a rotating connection which opens into a coaxial duct 48 enabling a coaxial cylindrical chamber 49 situated in the lower part of the shaft 41 to be fed.

O-ring seals 37, 38 are provided to ensure tightness on both sides of the vortex chamber 46 while allowing rotation of the head 16.

The chamber 49 enables the three channels 54, 55, 56 to be fed with cleansing fluid.

Figure 4:
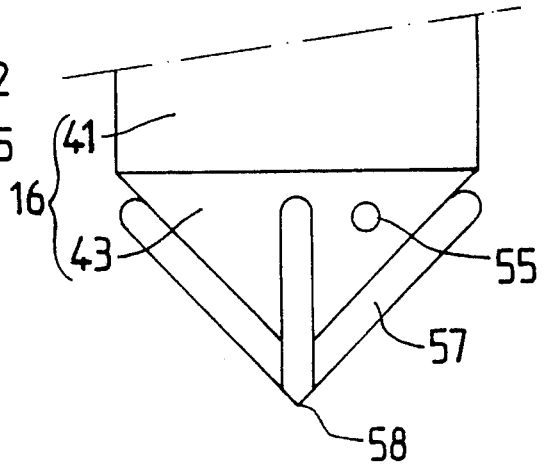
FIG. 4 shows the tip of the drilling head.

FIG. 4, which represents the perforating and cleaning head 16, shows that the conical part 43 is partially covered by a cruciform rib 57, e.g. in bronze so as to eliminate all risks of sparks during the perforating.

This rib has a tip 58 situated coaxially with the conical part 43 and intended to bore the walls of the barrel, and sharp edges provided to tear the edges of the bore to enlarge it more easily in order to enable the tube 13 to pass inside the barrel.

In the initial working position, the piston 9 of the jack 2 and the perforating and cleaning mechanism 12 are in the upper position, with the head 16 retracted into the guide sleeve 18. The cylinder body 8 of the jack 2 is maintained in the extended position through the action of the locking means V which is then in the locked position.

From this position, a barrel 6 can be inserted into the chamber 1. The crushing table 3 is then lowered by means of the jack 2 until it comes into contact with the barrel 6 to block it on the base 7. To this end, the lower side of the plate 3 is fitted with spines 65, 66 which dig slightly into the upper wall of the barrel 6.

The next stage consists in lowering the mechanism 12 to the lower position by means of the jack 26 so as to successively bore the upper side, then the lower side of the barrel 6 until the head 16 penetrates the opening 19.

In view of the relatively large diameter of the head 16, in the region of some ten centimeters, the edges of the perforations performed in the barrel 6 have downwardly curved lips, those of the lower bore engaging partially into the opening 19.

Furthermore, metal barrels usually have vertical rims 61 to 64. Perforation by pressure applied from below thus forms a funnel in the lower side of the barrel 6.

Once the mechanism 12 has reached the lower position, the next stage, which concerns the cleaning of the barrel 6, consists in simultaneously commanding:

the raising of the mechanism 12 to the upper position at a speed determined as a function of the degree of contamination of the barrel, the starting of the motor 32 so as to rotate the head 16, and the feeding of the head 16 via the pipe 42 with cleansing fluid at a pressure adapted to the degree of contamination of the barrel.

During this stage, by means of the rotation of the head 16 and the orientation of the channels 54, 55, 56, the entire inner surface of the barrel 6 is sprayed with cleansing fluid which can be e.g. water projected at a rate in the region of 37 liters per minute at a pressure exceeding 200 bars.

The residual cleansing fluid flows out through the opening 19 into the retention vat 20 by way of the funnel shape of the inner wall of the barrel 6.

Once the mechanism 12 has returned to the upper position, the jack 2 is activated to drive the crushing plate 3 downwards and to crush the barrel 6 so as to reduce it to a thin cake. During this operation, the jack 24 is operated to drive the burring element 21 into the opening 19 so as to turn the lower bore lips of the barrel 6 back upwards and to disengage them from the opening 19.

At the end of the crushing, the plate 3 is raised to the upper position to return to the initial position. In this position, the cleaned barrel 6 reduced to the shape of a cake can be removed effortlessly from the base 7, the lips of the lower perforation having been cleared away from the opening 19, and a new barrel can be inserted into the chamber 1.

Once the last barrel has been crushed and extracted, the device can be put into the retracted state, e.g. with a view to transportation thereof.

To this end, during a first stage the perforating mechanism 12 is brought into the cleaning position until the perforating head 16 is situated inside the guide sleeve 18.

The jack 2 is then acted upon (admission of fluid into the upper chamber of the jack 2) so as to bring the plate 3 onto the base 7, this action further having the effect of returning the gantry P and the perforating mechanism 12 inside the enclosure 1.

Figure 2:
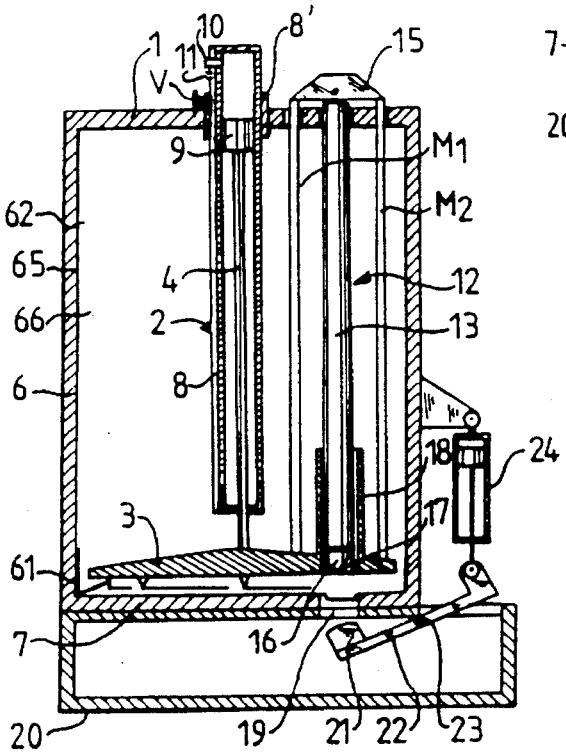
FIG. 2 is an axial sectional drawing showing the device in the retracted position.

The cylinder body 8 of the jack 2 is then axially released by unscrewing the binding screws before injecting pressurized fluid into the lower chamber of the jack 2. This injection then has the effect of causing a downward displacement of the cylinder body 8, until it is largely contained within the enclosure 1 (FIG. 2).

The device is then in the retracted position and can then be transported easily.

I claim:

1. A device for the preparation of used metal barrels having a cylindrical side as well as upper and lower sides, said device having a hydraulic press comprising an enclosure intended to receive said barrels and comprising an upper support side, a dual action hydraulic jack having a vertical body which is slidingly mounted through said support side and which comprises an actuating rod having a lower end which bears a crusher platen vertically mobile inside said enclosure, a base located opposite said platen, on which said barrels are positioned to be crushed by said platen, a perforating and cleaning mechanism comprising a cylindrical tube mounted vertically slidable through an opening in said platen and through an opening of said upper support side, said tube being ended at its lower part by a perforating head, a vertical gantry mounted fixedly on said platen and supporting said perforating and cleaning mechanism by means of a jack, said gantry being mounted vertically slidable through said upper support side, and means for locking said vertical body on said upper support side in the two following vertically spaced positions:

a retracted position in which said vertical body is largely contained inside said enclosure, and an extended position in which said vertical body is largely outside said enclosure, and in which said device can be operated.

2. The device as claimed in claim 1, wherein said perforating head comprises a head for injection of cleansing fluid.

3. The device as claimed in claim 2, wherein said perforating and cleaning mechanism performs an operating cycle comprising a perforation stage carried out from a raised initial position during a vertical downward displacement of said perforating mechanism, and a cleaning stage taking place when said mechanism rises to said raised initial position.

4. The device as claimed in claim 1, wherein said perforating head is conical and is fitted with radially protruding ribs extending along the generators of said head.

5. The device as claimed in claim 4, wherein said perforating head serves also as injection head having projection means, is mounted coaxially rotational and comprises a drive means for rotating said injection head about itself so as to ensure uniform projection of a cleaning fluid in said barrel, during the raising of said head.

6. The device as claimed in claim 5, wherein the projection means is oriented according to three axes to ensure uniform projection of said cleansing fluid on said cylindrical side and on said upper and lower sides of said barrel.

7. The device as claimed in claim 1, wherein the base of the enclosure has an opening serving for the passage of said perforating head when effecting a perforation of said lower side of said barrel and for an evacuation of residual cleansing fluid towards a retention vat placed below said base.

8. The device as claimed in claim 4, wherein said conical head, which comes into contact with said barrel to perforate it, is made of an explosion-proof material.

9. The device as claimed in claim 6, wherein said projection means comprises three channels respectively oriented horizontally, and substantially at angles of 30° and 45° to a horizontal axis.

10. The device as claimed in claim 7, wherein the base of the enclosure comprises a burring element intended to clear said perforation on said lower side of said barrel.

11. The device as claimed in claim 10, wherein said burring element is attached to a lever activated by a hydraulic jack so as to engage in said opening in the base.

* * * * *